US006180196B1

(12) United States Patent
Glover et al.

(10) Patent No.: US 6,180,196 B1
(45) Date of Patent: Jan. 30, 2001

(54) MANUFACTURE OF SIMULATED HERITAGE WINDOWS

(75) Inventors: Michael Glover; Stephen Field, both of Ottawa (CA)

(73) Assignee: Bowmead Holding Inc., Ontario (CA)

( * ) Notice: Under 35 U.S.C. 154(b), the term of this patent shall be extended for 0 days.

(21) Appl. No.: 09/193,125

(22) Filed: Nov. 17, 1998

(51) Int. Cl.[7] ..... E06B 3/24
(52) U.S. Cl. ..... 428/34; 428/207; 52/786.1
(58) Field of Search ..... 428/34, 120, 195, 428/207, 913; 156/62, 107, 109, 277; 52/314, 455, 786.1, 786.11

(56) References Cited

U.S. PATENT DOCUMENTS

| | | | |
|---|---|---|---|
| 3,226,903 | 1/1966 | Lillethun | 52/616 |
| 3,420,730 | 1/1969 | Ellefson | 161/38 |
| 4,154,880 | 5/1979 | Drennan | 428/38 |
| 4,335,170 | 6/1982 | Butler | 428/38 |
| 4,438,165 | 3/1984 | Butler | 438/38 |
| 4,488,919 | 12/1984 | Butler | 156/153 |
| 4,495,739 | 1/1985 | Drennan | 52/308 |
| 5,494,715 | 2/1996 | Glover | 428/34 |

FOREIGN PATENT DOCUMENTS

| | | |
|---|---|---|
| 1000698 | 1/1961 | (GB) . |
| 2140348 | 5/1984 | (GB) . |

*Primary Examiner*—Donald Loney
(74) *Attorney, Agent, or Firm*—Wenderoth, Lind & Ponack, L.L.P.

(57) ABSTRACT

Simulated heritage windows e.g. in the appearance of leaded or stained glass panels are made by applying strips of material such as plastic tape in predetermined patterns on registering surfaces of the sheets which make up a double or triple glaze window. The strips can be applied in any desired pattern, e.g. rectilinear or diamond shaped and are applied in an automated manner by tape dispensing heads that are moved over the glass surface in parallel. The production system includes a conveyor for transporting the glass sheets as well as a rotary suction cup which grips the sheets and enables its rotation through e.g. 90° when a second set of strips is to be applied at right angles to the first strip. The apparatus also includes a turntable by means of which the glass sheet can be flipped over or inverted when strips are to be applied to both of its sides.

14 Claims, 9 Drawing Sheets

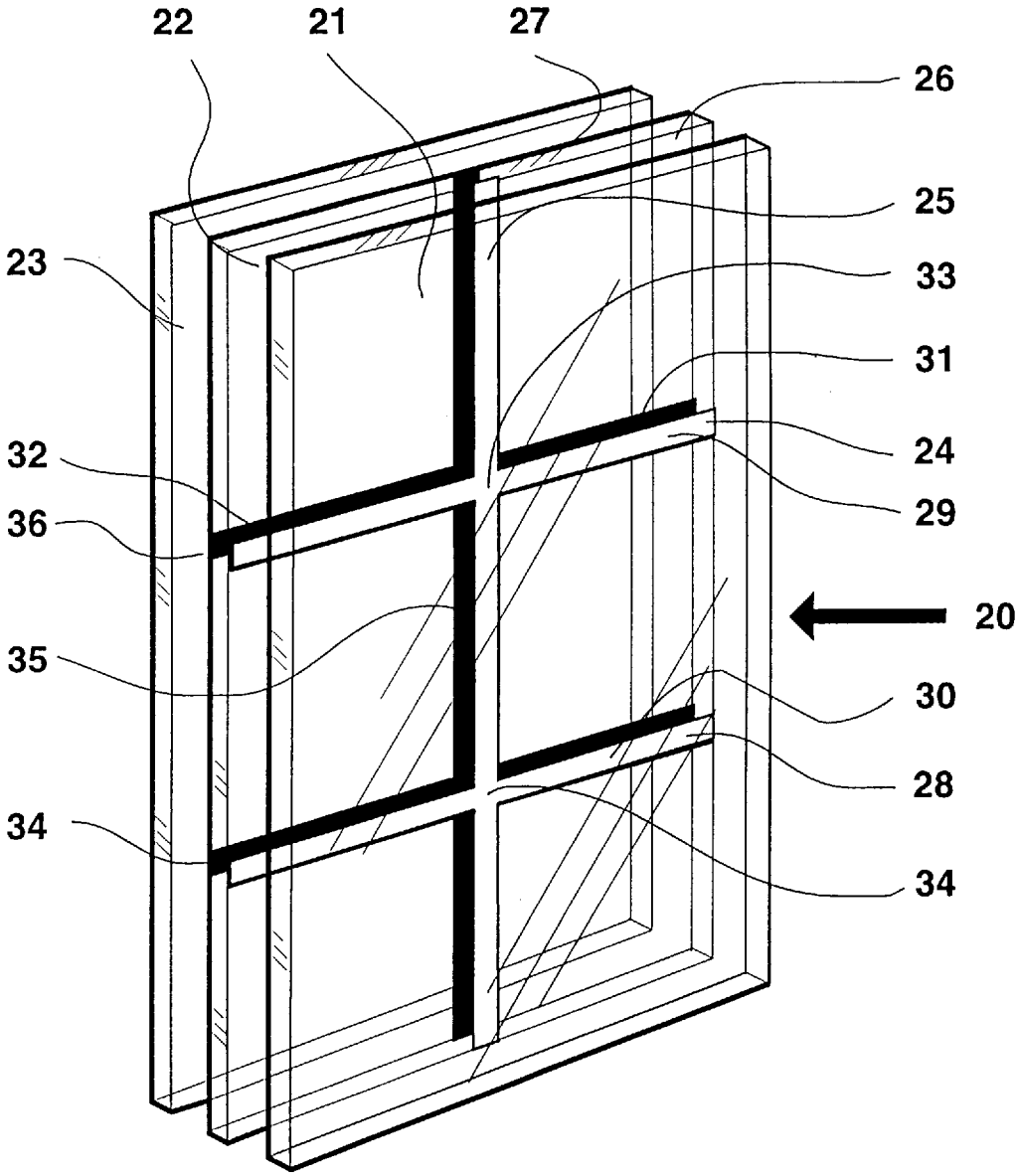
Figure One

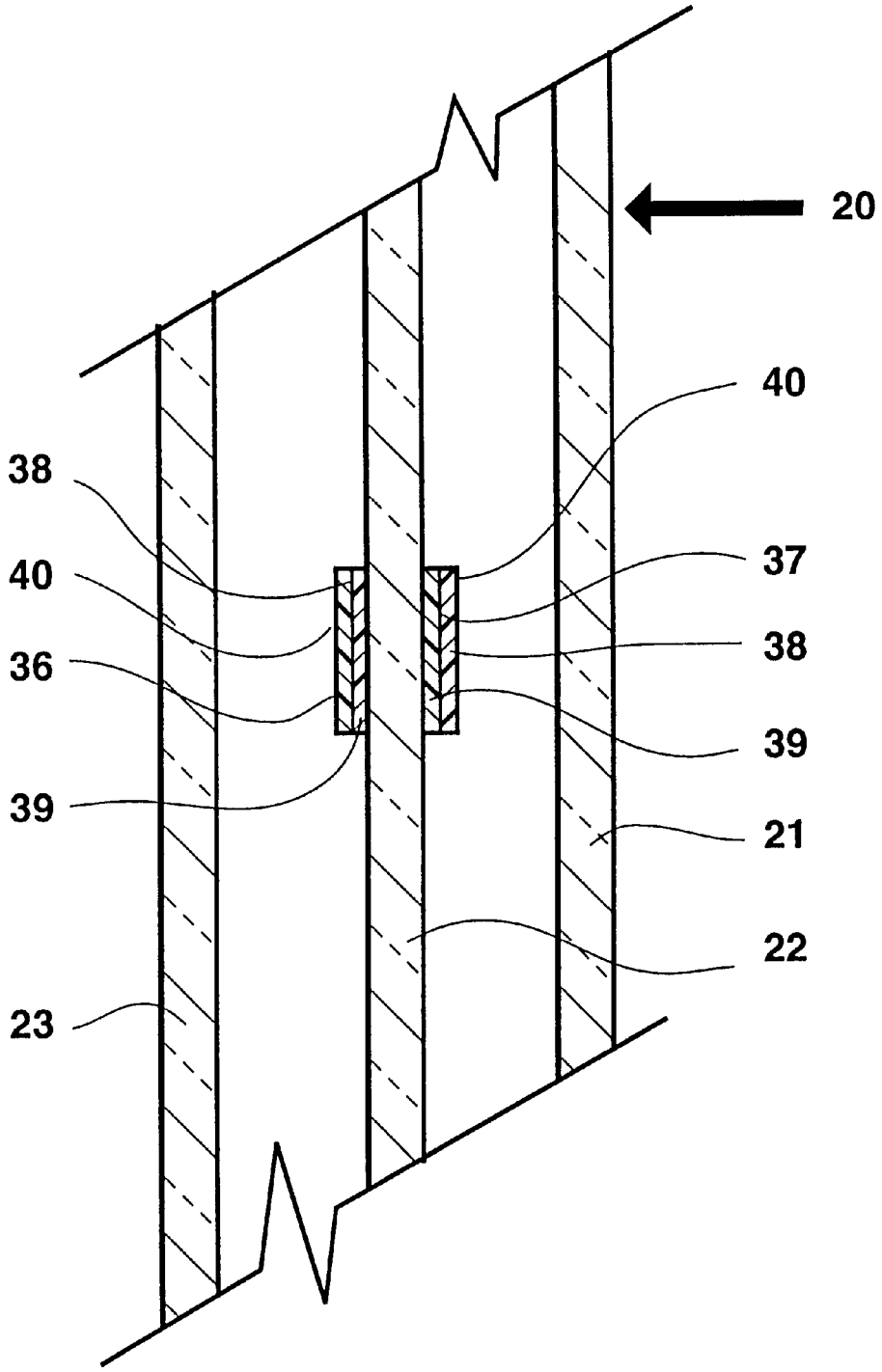
Figure Two

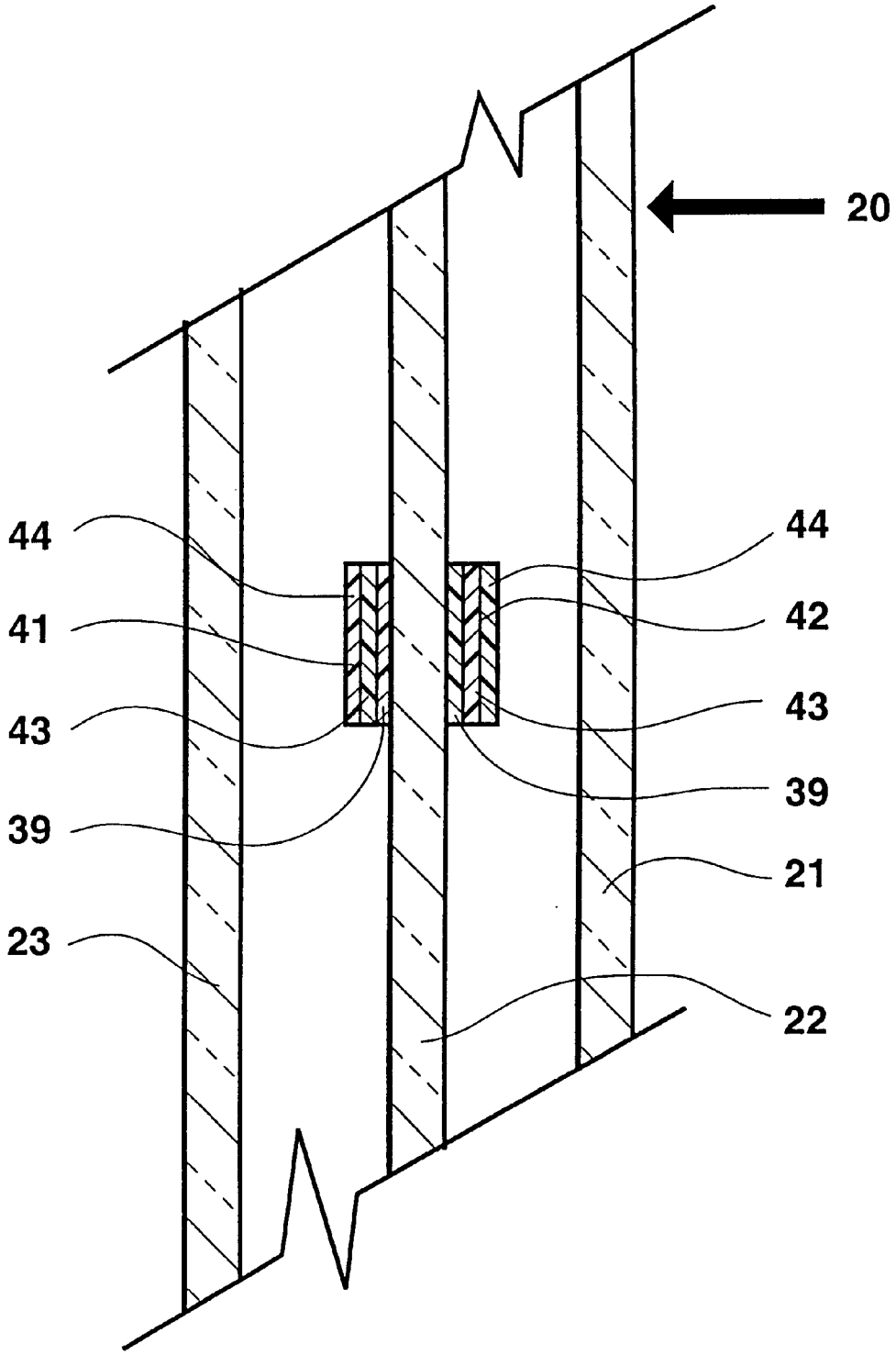
Figure Three

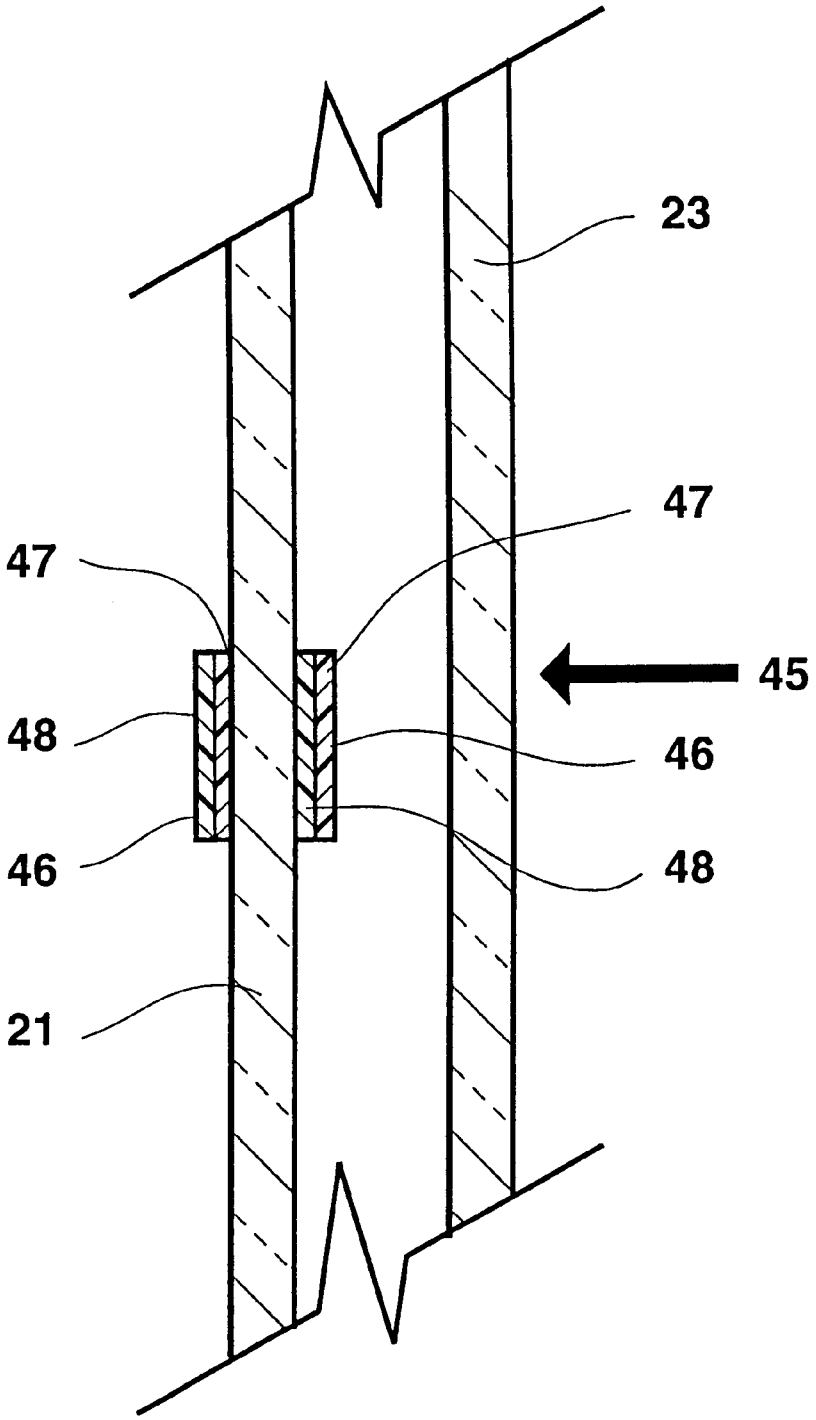
Figure Four

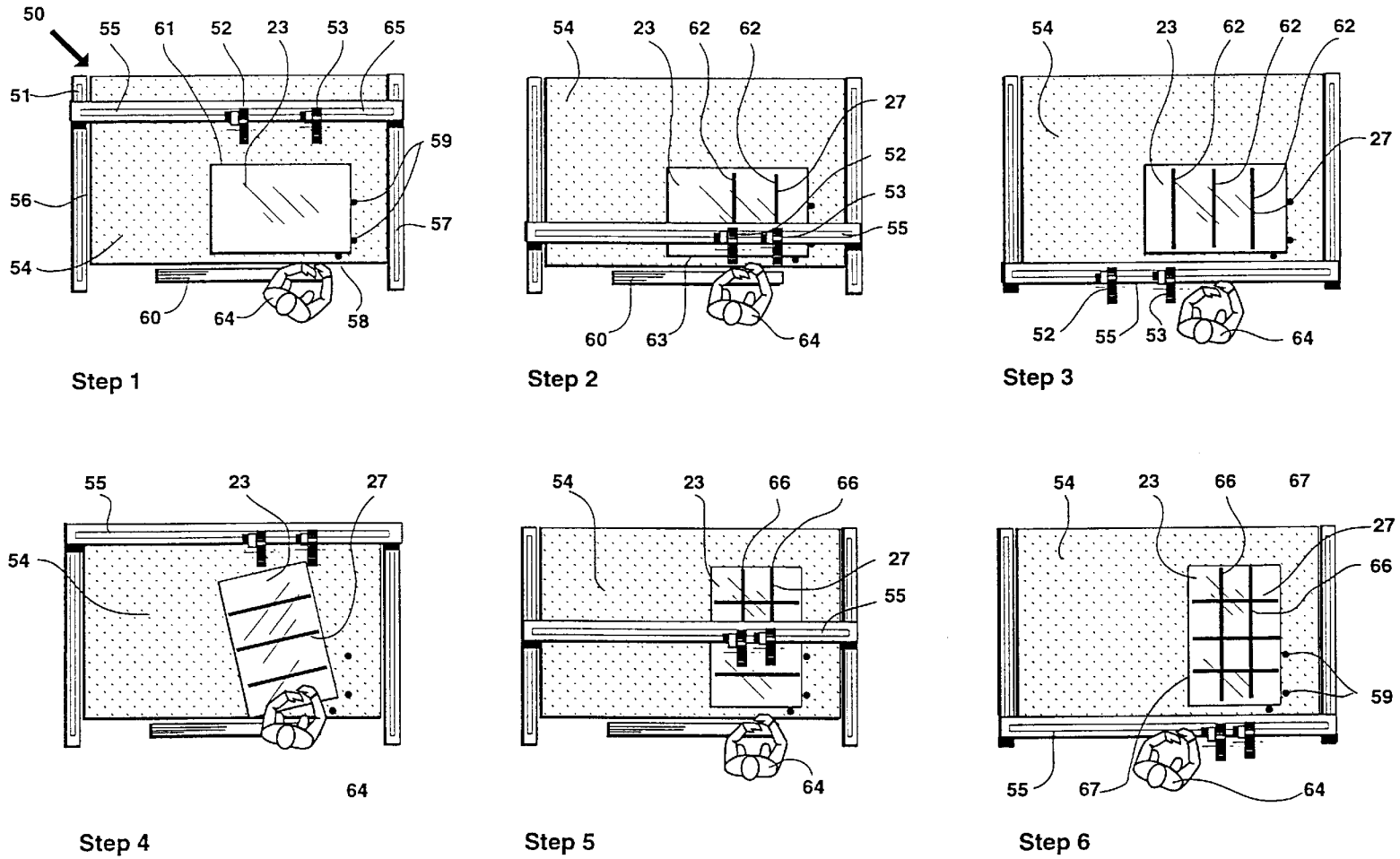
Figure Five

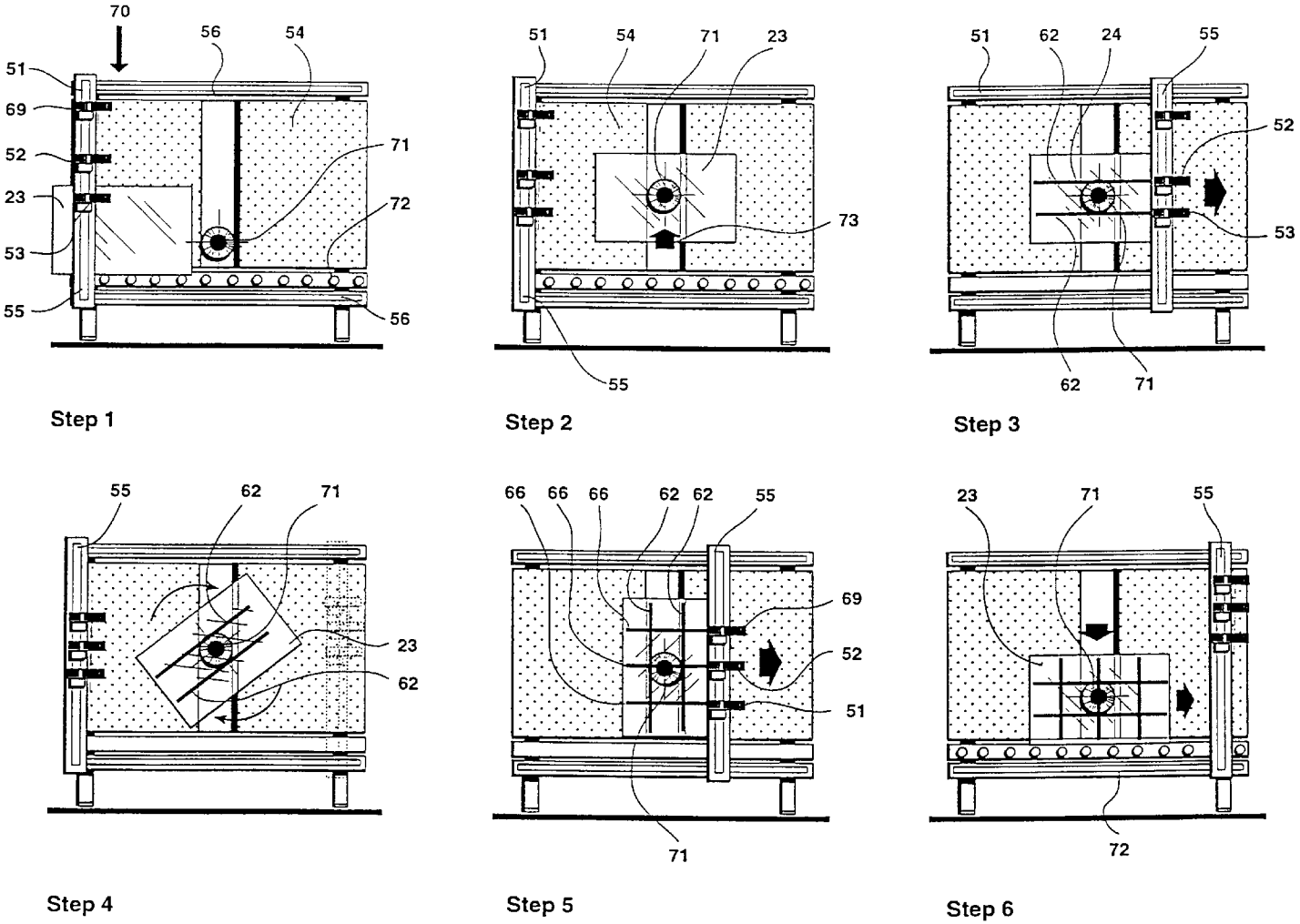
Figure Six

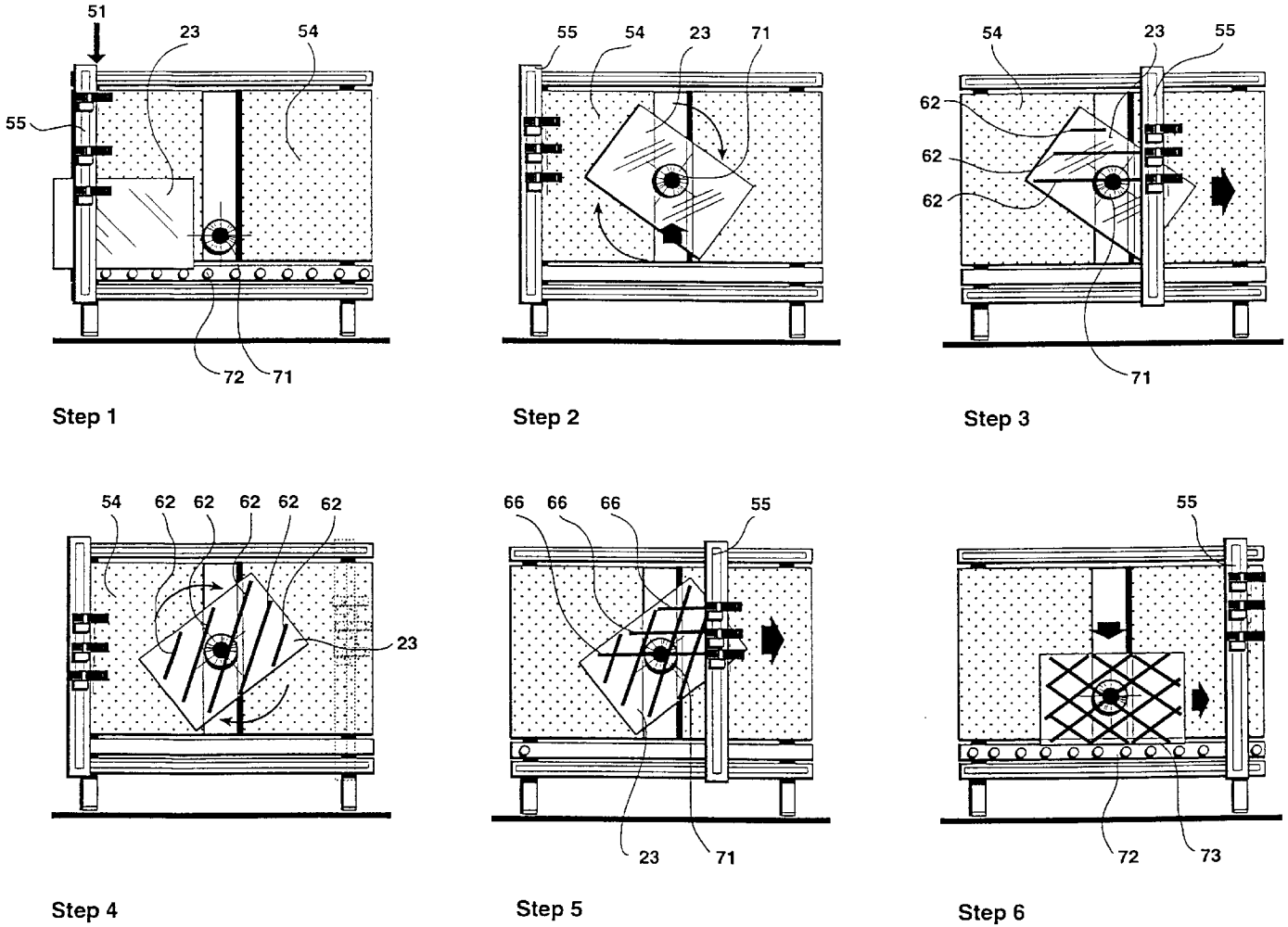
Figure Seven

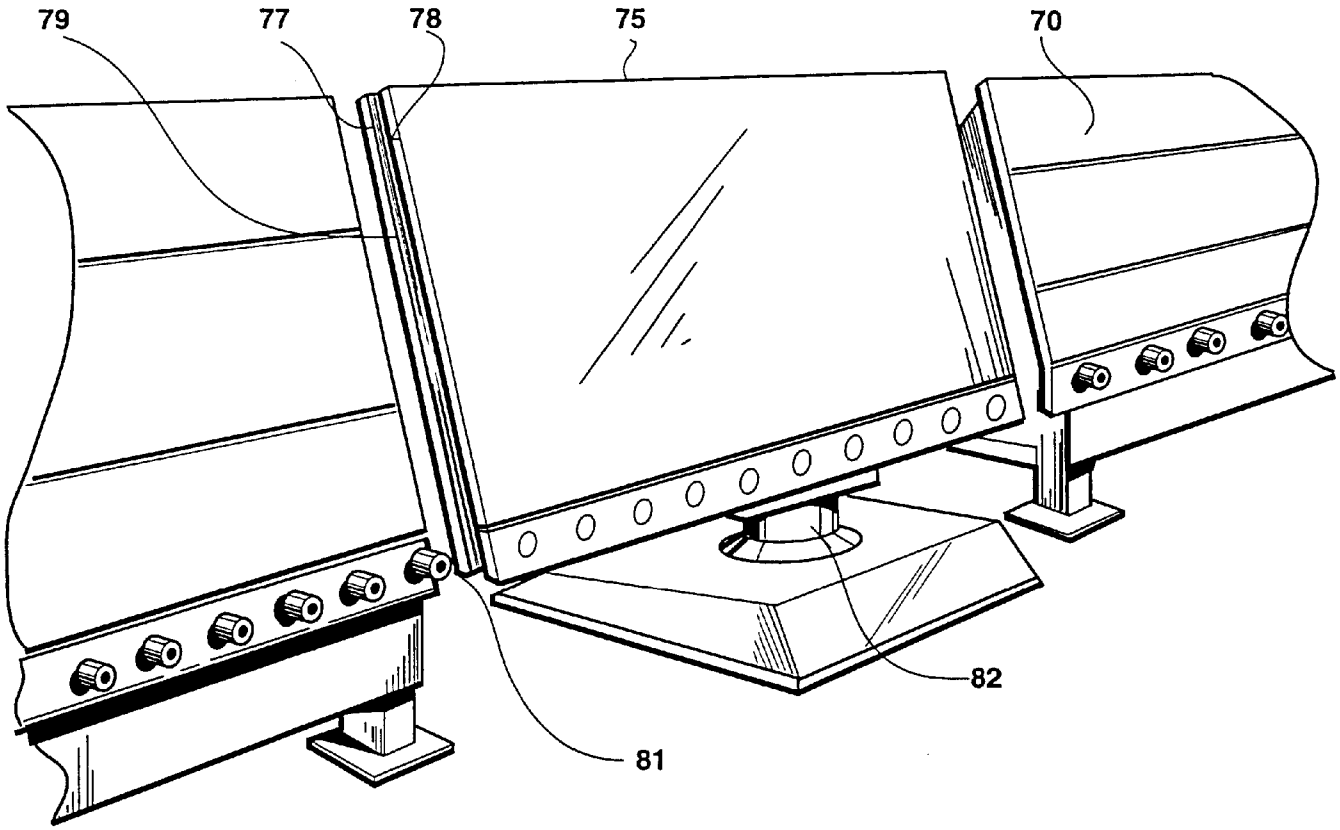
Figure Eight

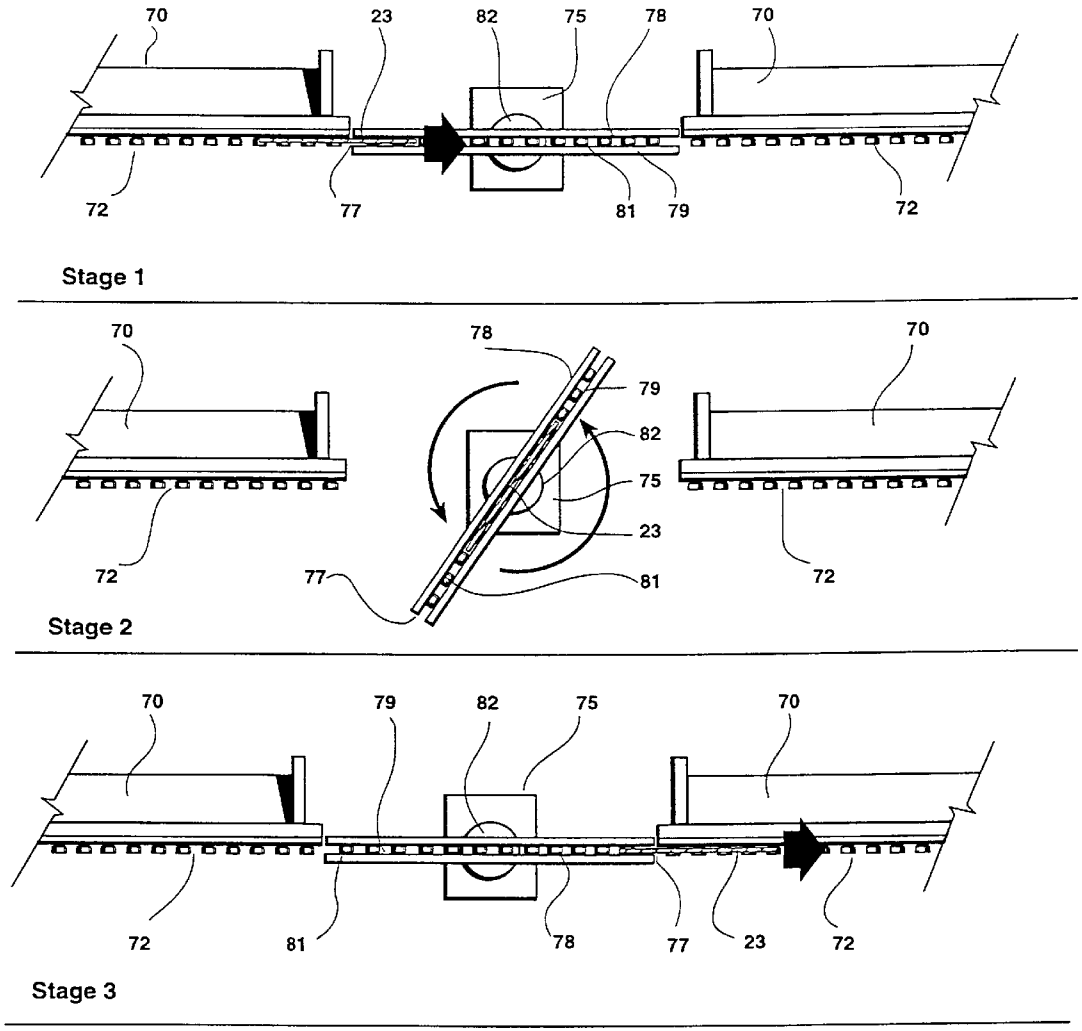
Figure Nine

MANUFACTURE OF SIMULATED HERITAGE WINDOWS

BACKGROUND OF THE INVENTION

1. Field of Invention

This invention relates generally to methods for the manufacture of multiple-pane sealed glazing units and more particularly of units that incorporate decorative features that simulate the appearance of leaded or stained glass panels, and also to units products by such methods.

2. Description of the Prior Art

In U.S. Pat. No. 5,494,715 issued to Glover, there is a description of the various efforts that have been made in recent years to improve the energy efficiency and condensation resistance of multiple-glazed sealed units. These improvements include: low-e coatings, argon or krypton gas fill, narrow width cavities and insulating spacing-and-desiccant systems for perimeter edge seals.

As noted in the U.S. Pat. No. 5,494,715, there is also a growing consumer interest in heritage window features with one popular feature being leaded or stained glass panels. Traditionally, these panels have been made by hand using grooved lead strips or cames. In the past because these handcrafted panels were very labor intensive to produce, various efforts have been made to simplify traditional production techniques and these efforts have been documented in the patent literature.

U.S. Pat. No. b 3,226,903issued to Lillethun describes a triple-glazed sealed unit with a traditional stained-glass panel being incorporated as the center glass lite.

U.S. Pat. Nos. 4,335,170 and 4,438,165 issued to Butler describe a stained glass panel fabricated from a single glass pane where lead profiles are adhered in coincidental alignment to either side of a flat glass sheet. The extruded lead profiles are manually applied and are approximately 0.022 inches in thickness. Because of the stiffness and thickness of the lead profiles, the top lead profile has to be stretched and bent around the bottom lead profile and as a result, the process has to be carried out manually with each lead profile being individually applied.

U.S. Pat. No. 5,494,715 issued to Glover describes a triple pane unit with the center glass pane located only ⅛" away from the front glass lite. To create the visual illusion of a solid lead came, three thin stripes are applied. One stripe is applied to the cavity face of the front glass sheet and the other two stripes are applied to either side of the center glass sheet. Traditional lead cames are grey in color, and if all three decorative stripes are colored grey, experience has shown that because of various optical and shadow effects, the visual illusion of a traditional leaded pane window is not always convincingly created.

For the triple stripe method described in U.S. Pat. No. 5,494,715, one key potential advantage is that the production process can be automated with the objective of producing over a 1000 decorative glass units per eight hour shift. However, the horizontal production equipment described involves glass sheets moving below a multi-head bridge assembly and no automated method or technique is given for applying the stripes to the opposite side of the glass.

SUMMARY OF THE INVENTION

The invention provides a method of applying decorative thin strips to a flat glazing sheet, said method comprising: applying a set of decorative thin strips on one side of a flat glazing surface; rotating said glazing sheet through a given angle and applying a second set of decorative thin strips at said given angle to first set of strips, said strips of the second set crossing and overlying said strips of the first set at points of intersection; wherein at least one of said sets of thin strips is applied in stages and each stage involves simultaneously applying two more thin strips.

The method may also include the further steps of flipping over the glass sheet and applying on the other side third and fourth sets of decorative thin strips in coincidental alignment with the thin strips of the first and second sets.

The given angle of intersection of the strips of different sets is chosen to suit the particular circumstances, e.g. at 90° where a rectilinear muntin bar appearance is to be achieved, or 60° where a diamond pattern is sought.

The strips can be applied with the glass sheet in a generally horizontal position, but preferably will be applied with the glass sheet in a generally upright position as providing a more convenient attitude in which the glass sheet can be flipped over or reversed, e.g. by the use of a turntable swivelling on a vertical axis, when the second side of the sheet is to be operated on.

The method described lends itself to automation through the use of air float/suction table surfaces to support the glass, and automatically guided and operated tape heads for applying tape to the glass to form the desired strip patterns.

From another aspect the invention provides a system of apparatus for carrying out the above discussed methods.

From another aspect the invention provides a sealed glazing unit that simulates the appearance of traditional metal came panels, said sealed glazing unit comprising: two or more parallel coextensive glazing sheets; peripheral seals extending continuously between the edges of said glazing sheets to define one or more glazing cavities between said sheets; decorative thin strips located on both flat surfaces of one of said glass sheets, said thin strips on respective surfaces being in mutually aligned registration with each other; wherein said decorative thin strips have one side that is of a relatively light shade and an opposite side that is of a relatively dark shade, said strips being attached to said glazing sheet in an orientation such that the side of relatively light shade is presented toward the adjacent exterior side of the glazing unit, whereas the side of relatively dark shade to is presented towards the interior side; wherein said strips are less than 0.005" in thickness and arranged on each side of said one glass sheet in sets of parallel strips, said sets being arranged at a predetermined angle to each other to create a decorative grid pattern.

Where the strips are applied in the form of thin plastic strips with pressure sensitive adhesive securing them to the glass, then on each side of the glass the strips of one set overlap and overlie the strips of the other set at the points of intersection, the thickness of the strips being sufficiently small (less than 0.005", and preferably about 0.002") to enable this overlap to be accomplished without difficulty.

The plastic sheet material could conveniently be polyethylene terephthalate (PET), or the plastic tape could be made from a double lamination of plastic sheet material one side of which has a light shade and the other a dark shade. The light shade for example may simulate the appearance of lead or brass.

Alternatively the thin strips applied to the glass may be made of ceramic frit material which may be applied using heat release decals.

BRIEF DESCRIPTION OF THE DRAWINGS

The following is a description by way of example of certain embodiments of the present invention, reference being made in the accompanying drawings, in which:

FIG. 1 shows a fragmentary perspective view of a triple glazing unit that simulates the appearance of a leaded or stained glass window.

FIG. 2 shows an enlarged cross section detail of the triple glazing unit shown in FIG. 1 and featuring a double assembly of coated plastic film adhesive tapes on the center glass lite.

FIG. 3 shows an alternative cross section detail of the triple glazing is unit shown in FIG. 1 and featuring a double assembly of dual laminated plastic film adhesive tapes on the center glass lite.

FIG. 4 shows an alternative cross section detail of a double glazed glazing unit featuring a double assembly of dual-tone ceramic frit material on a single glass pane.

FIG. 5 shows plan views of the production steps for horizontal application of decorative adhesive tapes to one side of a glass sheet that is intended to be the center sheet of a stained or leaded glass panel.

FIG. 6 shows elevational views of the production steps for vertical application of decorative adhesive tapes to create a rectangular grid pattern.

FIG. 7 shows elevational views of the production steps for vertical application of decorative adhesive tapes to create a diamond grid pattern.

FIG. 8 shows a partial perspective view of an automated glass flipping station.

FIG. 9 shows plan views of the production steps for automated glass flipping.

DESCRIPTION OF THE PREFERRED EMBODIMENTS

FIG. 1 shows a fragmentary perspective view of a triple glazing unit that simulates the appearance of a leaded or stained glass window. The glazing unit 20, consists of three glazing sheets; an inner glazing sheet 21, an outer glazing sheet 23, and a center glazing sheet 22. A vertical strip 25 of adhesive tape material 24 is applied to the inner surface 26 of said center glazing sheet 22.

To create a grid pattern, horizontal strips 28 and 29 are applied at right angles to the vertical strip 25. At the intersection points 33 and 34 between the vertical and horizontal stripes, the horizontal stripes 28 and 29 are simply laid on top of the vertical stripe 25.

The adhesive tape material is typically made from a plastic sheet material with a pre-applied pressure sensitive adhesive. One preferred material option for the plastic sheet material is polyethylene terephthalate (PET) and one preferred material option for the pressure sensitive adhesive is acrylic.

The outer surface 30 of the tape is a relatively light shade while the inner adhesive surface 31 of the tape which contacts the glass is a relatively dark shade. For simulated leaded glass panels, the lighter shade is typically grey while the darker shade is black. For simulated brass came panels, the light shade is typically a metallized brass finish while the darker shade is black.

For ease of application, and so that there is no need to bend or stretch the tape at the intersection points 33 and 34, the sheet material should be less than 0.005" in thickness and preferably less than 0.002" in thickness.

A second vertical strip 35 is applied to the outer surface 27 of the center glass sheet 22. The second strip 35 is in coincidental alignment with the first strip 25. Similarly, a second set of horizontal strips 34 and 32 are applied to the outer surface 27 of the center glass sheet. This second set of horizontal stripes are also in coincidental alignment with the first set.

FIG. 2 shows a cross section detail of a triple glazed unit 20 featuring a double assembly of coated plastic film adhesive tapes 37 and 36 on the center glass sheet 22. The adhesive tapes are made from black PET sheet film material 38 with a pre-applied pressure sensitive acrylic adhesive 39. The black PET features a UV stable, metallized coating 40, with a shiny brass appearance.

FIG. 3 shows an alternative cross section detail of a triple-glazed unit 20 featuring a double assembly of dual-laminated plastic film adhesive tapes 41 and 42 on the center glass sheet 22. The adhesive tapes 41 and 42 are made from a dual-lamination of PET sheet film material 43 and 44 and with a pre-applied pressure sensitive adhesive 39. The PET film 43 adjacent to the glass sheet is typically colored black while the outer sheet 44 is a grey or yellow brass colored PET.

FIG. 4 shows a cross section detail of a double glazed unit that simulates the appearance of a leaded or stained glass window. The glazing unit 45 consists of two glazing sheets, an inner glazing sheet 21 and an outer glazing sheet 23. Thin strips of ceramic material 46 are applied to either side of the inner glazing sheet. The ceramic material is a dark shade on the bottom surface 47 adjacent to said glazing sheet and a light shade on the top surface 48.

The thin strips of ceramic material can be produced either by applying continuous strips of heat release decal transfers to create a grid pattern or by applying large heat release ceramic decals on either side of the glazing sheet 21.

The large size decals incorporate a metal came design and may also incorporate decorative colored areas to simulate the appearance of traditional stained glass windows. After the decal transfers have been applied, the glass sheet is heated to a high temperature and the ceramic material is fused into the glass surface creating a very durable finish that does not degrade or color fade over time.

FIG. 5 shows plans views of the production steps for the horizontal application of decorative adhesive tapes 27 to one side of a center glazing sheet 23 that is stationary.

The first step is to transfer a glazing sheet 23 to a horizontal tape application table 50. Key features of the tape application table include: a linear motion system 51, two or more tape heads 52, 53 and an air float/suction surface 54. The linear motion system 51 consists of a moveable rigid beam 55 that spans between a side activator 56 and a side guide rail 57. The moveable rigid beam 55 incorporates a positioning rail 65 that allows the tape heads to be accurately positioned either by automated or manual means. The air float surface 54 is activated by a hip bar 58 operation and the glazing sheet 23 is moved into position and held against a popup stop 59. Again through a hip bar 58 operation, the air flow for the air float surface 54 is reversed and the glass sheet 23 is held firmly in position through air suction.

By means of a foot pedal operation 60, the linear motion system 51 is activated and the rigid beam 55 moves forward from its home position. Through optical sensors (not shown), the top edge 61 of the glazing sheet 23 is identified.

The tape heads 52 and 53 are then automatically activated and start to apply tape strips 62 at a specified distance from the top edge of the glass. As the rigid beam 55, moves across the glazing sheet 23, two or more adhesive tape strips are applied (See Step 2).

The bottom edge 63 of the glazing sheet 23 is identified again by means of optical sensors and the tape heads 52 and 53 are automatically deactivated at a specified distance from the bottom edge 63 of the glass sheet 23. The moveable rigid beam 55 then automatically stops in position in front of the operator 64. From computer-generated instructions, the operator 64 repositions the tape heads 52 and 53 using either automated or manual means (See Step 3). Through a foot pedal operation 60, the moveable beam 55 is then activated and moves back to its original home position 65. Depending on the complexity of the grid pattern, the process is again repeated and a further one or more strips are applied to the glazing sheet 23.

When all the strips 62 have been applied in one direction, the air float surface 54 is activated to release the suction and provide an air float and the glazing sheet 23 is rotated through 90° (See Step 4). A series of strips 66 are then applied at right angles to the original set 62 (See Step 5). After the second set of strips 65 have been applied (See Step 6), the glazing sheet 23 is manually flipped and is again positioned against the pop-up stop 59. A second grid pattern is then applied to the opposite side of the glazing sheet 23 and these strips are coincidentally aligned with the first grid pattern 67.

FIG. 6 shows elevation views of the production steps for vertical application of decorative adhesive tapes 24 to create the rectangular grid pattern.

The first production step is to automatically transfer a clear glazing sheet 23 to a vertical tape application station 70. Key features of the tape application station include: a linear motion system 51, two or more tape heads 52,53 and 69 and a moveable rotating suction cup 71. The linear motion system 51 consists of a moveable rigid beam 55 that spans between two side activators 56. The moveable rigid beam 55 incorporates a positioning rail 58 that allows the tape heads 52,53 and 69 to be accurately positioned through automated means.

The air float surface 54 is automatically activated and a glazing sheet 23 is automatically transferred by means of a motorized wheel track system 72. Through a system of electronic controls and sensors, the glazing sheet 23 is centrally positioned on a moveable rotating suction cup 71. The wheel track system 72 is retracted and the suction cup 71 is automatically activated moving the glazing sheet 21 to a reference location 73 (See Step 2). The air flow to the air float surface 54 is deactivated and the glass sheet 23 is held firmly in position through both air suction and the moveable suction cup 71.

The linear motion system 51 is then activated and the rigid beam 55 moves across the glazing sheet automatically applying two or more adhesive strips 62 to the glazing sheet 23 (See Step 3). As with horizontal tape application, the process is repeated until all the strips have been applied in one direction. The air float surface 54 is then activated and the glazing sheet 23 rotated through 90° by means of the moveable suction cup 71. (See Step 4). A second set of strips 66 is then applied at right angles to the first set of strips 62 (See Step 5). The glass sheet 23 is again rotated so that the longest glass side is perpendicular to the moveable beam 55 and the glass sheet 23 is then repositioned on the wheel track system 72.

FIG. 7 shows elevation views of the production steps for vertical tape application of decorative adhesive tapes to create a diamond grid pattern. As with the production of rectangular grids, the glazing sheet 23 is centered on a moveable suction cup 71. The suction cup 71 is moved upwards to a reference location and the glass sheet 23 is rotated and positioned at a given angle to the moveable beam 55. The air float surface 54 is deactivated and the glass sheet is firmly held in place by means of both air suction and the moveable suction cup 71. The linear motion system is then activated and the rigid beam 55 moves across the glazing sheet automatically applying two or more adhesive strips 62 to the glazing sheet 23. The process is repeated until all the strips have been applied in one direction.

The air float surface 54 is then activated and the glazing sheet is rotated through a given angle by means of the moveable suction cup 71. A second set of stripes 66 are then applied at a given angle to first set of strips 62. The glass sheet 21 is again rotated so that the longest glass side 73 is perpendicular to the moveable beam 55 and the glass sheet is repositioned on the wheel track system 72.

FIG. 8 shows an elevation view of an automated vertical glass flipping station 75 that is used in combination with the automated vertical tape application station 70.

After the first adhesive tape grid pattern 67 has been applied to one side of the glazing sheet, the glass sheet is then flipped over prior to application of a second tape grid pattern that is aligned with the first grid pattern.

One way of flipping over the glazing sheet is by means of an automated glass flipping station 75 that is similar in function to a traditional steam train turntable. Key features of the automated glass flipping station include: a transfer slot 77, air floatisuction surfaces 78 and 79 on either side of the transfer slot 77, a reversible wheel track system 81 and a motorized turn table 82.

FIG. 9 shows plan views of the production steps for automated glass flipping. A glass sheet 23 is transferred to the slot 77 within the automated glass flipping station 75 by means of the motorized wheel track system 81. Once fully enclosed within the slot 77, the glass sheet 21 is automatically stopped. The air float surface on the slot face 78 is reversed and the glass sheet is firmly held in position by means of suction. The automated glass flipping station is turned through 180° about a vertical axis until the slot 77 is once more accurately aligned with the wheel track system 72. The suction is slot face 78 is reversed and the drive direction of the wheel track system 81 is also reversed.

The glass sheet 23 exits the slot 77 and proceeds to a second automated tape application station 70 where a second adhesive tape grid is applied in coincidental alignment with the first grid pattern but on the opposite surface of the glass sheet.

What is claimed is:

1. A sealed glazing unit that simulates the appearance of traditional metal came panels, said sealed glazing unit comprising:

two or more spaced apart parallel co-extensive glazing sheets;

at least one peripheral seal extending continuously between edges of said glazing sheets to define at least one glazing cavity between said glazing sheets;

at least one pair of decorative thin strips respectively located on opposing surfaces of one of said glazing sheets, said pair of decorative thin strips being in mutually aligned registration with each other;

wherein each of said pair of decorative thin strips has an inward face and an outward face, such that said inward faces of said pair of decorative thin strips face toward each other and said outward faces of said pair of decorative thin strips face away from each other toward an exterior of said glazing unit;

wherein said outward faces of said pair of decorative thin strips are of a relatively light shade and said inward faces of said pair of decorative thin strips are of a relatively dark shade which is darker than said relatively light shade; and wherein each of said pair of decorative thin strips is less than 0.005 inches in thickness.

2. The sealed unit of claim 1, wherein said at least one pair of decorative thin strips comprises at least two pair of the decorative thin strips, said pairs of the decorative thin strips being arranged in parallel to one another.

3. The sealed unit of claim 1, wherein said at least one pair of decorative thin strips comprises at least two pair of the decorative thin strips which are arranged at predetermined angles to each other to create a decorative grid pattern.

4. The sealed unit of claim 1, wherein said at least one pair of decorative thin strips comprises at least two pairs of the decorative thin strips arranged in crossing relation to each other; and the strips of one of said pairs of the decorative thin strips overlie the strips of another of said pairs of the decorative thin strips at points of intersection therewith.

5. The sealed unit of claim 1 wherein said decorative thin strips are formed of a material adhered to said one of said glazing sheets with a pre-applied pressure sensitive adhesive, and said one of said glazing sheets comprises a center glazing sheet of a triple glazed unit.

6. The sealed unit of claim 5 wherein said pressure sensitive adhesive is an acrylic adhesive.

7. The sealed unit of claim 5 wherein said decorative thin strips are made from plastic sheet material.

8. The sealed unit of claim 7 wherein said plastic sheet material is made from polyethylene terephthalate (PET).

9. The sealed unit of claim 7 wherein each of said decorative thin strips is made from a double lamination of plastic sheet material.

10. The sealed unit of claim 7 wherein each of said decorative thin strips is made from a plastic film with an applied light shade coating.

11. The sealed unit of claim 10 wherein said light shade coating gives the appearance of lead.

12. The sealed unit of claim 10 wherein said light shade coating gives the appearance of brass.

13. The sealed unit of claim 1 wherein said thin strips are made from ceramic frit material.

14. The sealed unit of claim 7 wherein said ceramic frit material is applied using heat release decals.

* * * * *